United States Patent [19]

Ishikawa

[11] 4,193,552

[45] Mar. 18, 1980

[54] LIQUID SPRAYER PIPE WITH INCLINED SLITS

[76] Inventor: Ken-ichi Ishikawa, 66-2 Nukatani 2-Chome, Kanazawa, Ishikawa Prefecture, Japan

[21] Appl. No.: 936,881

[22] Filed: Aug. 25, 1978

[30] Foreign Application Priority Data

Nov. 12, 1977 [JP] Japan ..... 52-125230

[51] Int. Cl.[2] ..... B05B 1/14; B05B 1/30

[52] U.S. Cl. ..... 239/533.13; 239/566; 239/567; 239/568

[58] Field of Search ..... 239/533.1, 533.13, 533.15, 239/542, 546, 547, 602, 566-568; 405/36, 39, 40, 43

[56] References Cited

U.S. PATENT DOCUMENTS

| | | | |
|---|---|---|---|
| 169,355 | 11/1875 | Grinnell | 239/567 |
| 2,030,830 | 2/1936 | Hibner, Jr. | 239/566 |
| 2,771,320 | 11/1956 | Korwin | 239/533.13 X |
| 3,293,861 | 12/1966 | Hinde | 239/533.13 X |
| 3,677,936 | 7/1972 | Bastiaanse | 239/533.13 X |

FOREIGN PATENT DOCUMENTS

| | | | |
|---|---|---|---|
| 525174 | 4/1931 | Fed. Rep. of Germany | 239/543 |
| 306820 | 8/1971 | U.S.S.R. | 405/43 |

*Primary Examiner*—Robert B. Reeves
*Assistant Examiner*—Andres Kashnikow
*Attorney, Agent, or Firm*—Cooper, Dunham, Clark, Griffin & Moran

[57] ABSTRACT

The liquid sprayer pipe made of a flexible material has liquid spraying slits inclined in an acute angle with respect to a wall of the liquid sprayer pipe. The slits are opened with vibrations by the pressure of a liquid which passes through the liquid sprayer pipe, whereby the liquid is sprayed in a wide range and in a long distance along the liquid sprayer pipe. In the case of a cylindrical pipe, the liquid spraying slits are formed along a tangent of an inner surface of the pipe.

10 Claims, 7 Drawing Figures

LIQUID SPRAYER PIPE WITH INCLINED SLITS

BACKGROUND OF THE INVENTION

The present invention relates to a liquid sprayer pipe having liquid spraying slits, made of an elastic and flexible material, such as rubber, and particularly to a water sprayer pipe having water spraying slits which are formed by cutting the wall of the water sprayer pipe in an acute angle with respect to the wall of the sprayer pipe and whose outlets are formed parallel to the flow of water in the water sprayer pipe. Conventionally, a water sprayer pipe having a number of openings in the longitudinal direction of the pipe for spraying water therefrom is well-known.

Furthermore, a water sprayer pipe having slit-shaped openings is disclosed in Japanese Utility Model 49-20915. However, the quantity of water sprayed from such slit-shaped openings is small and it is difficult to spray water uniformly in a wide range along the water sprayer pipe. Moreover, when the respective water spraying openings are spaced sufficiently, in some places along the water sprayer pipe, water is not sprayed. Therefore, there is a certain limit in the length of such water sprayer pipes. In general, when the water pressure is approximately 1.5 kg/cm$^2$ and the diameter of the water sprayer pipe is in the range of from 8 to 12 mm, the water spraying range is not more than 10 m along the water sprayer pipe, and the sprayed water reaches 4 m or less. Naturally, the water spraying range can be increased by increasing the pressure and the quantity of supplied water. However, this needs more water pumps and water pipes, while the above-mentioned shortcomings of the conventional water sprayer pipes are not removed, but they are intensified, so that water cannot be sprayed uniformly in a wide range.

SUMMARY OF THE INVENTION

It is therefore a principal object of the present invention to provide a water sprayer pipe capable of spraying water uniformly in a wide range and in a long distance along the water sprayer pipe.

In one embodiment of a water sprayer pipe according to the present invention, the water sprayer pipe is made of an elastic and flexible material, such as a rubber, and water spraying slits are formed by cutting a wall of the water sprayer pipe in an acute angle with respect to the wall of the pipe and in the direction parallel to the water flow in the water sprayer pipe. While water is not supplied to the water sprayer pipe, the slits are closed by the elasticity of the material of the water sprayer pipe, but when water is supplied to the water sprayer pipe, the slits are gradually opened by the pressure of water with the acute edges of the slits vibrated, so that water is sprayed from the slits in the form of very fine drops.

In another embodiment of a water sprayer pipe according to the present invention, an outlet of water on an inner side of each water spraying slit is designed so as to be larger than an inlet of water of each water spraying slit, so that the water spraying angle is broadened, in comparison with the water spraying openings or slits of the conventional water sprayer pipes whose water spraying openings or slits are formed in a right angle with respect to the wall of the pipes and at the same time, the water spraying distance and range can be increased in comparison with the conventional water sprayer pipes.

Particularly when the cross section of a water path of the water sprayer pipe is circular, it is most effective for spraying water to form the water spraying slits along a tangent of the water path, but as the angle of the water spray slits is increased from the tangent, the water spraying performance of the water sprayer pipe gradually becomes poor and when the angle is increased to about 60 degrees, the water spraying performance is lowered to that of the conventional water sprayer pipes having the right angle openings or slits.

According to the present invention, under a water pressure, the water spraying pipe can be lengthened more than 5 times that of the conventional water spraying pipes and the water spraying range can be broadened more than 10 times that of the conventional water spraying pipes.

The present invention is not only applied to the spraying of water, but also to the spraying of any liquids in many fields, such as farms, gardens, athletic fields, roads, irrigation facilities, cleaning facilities, snow melting facilities, coolers, and heat exchangers.

DETAILED DESCRIPTION OF THE PREFERRED EMBODIMENTS

Figure 1:
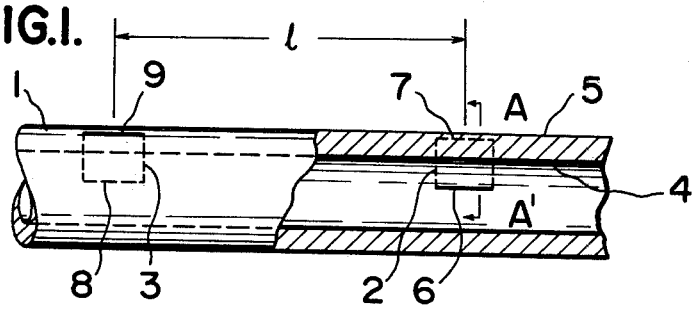
FIG. 1 is a schematic partially sectional side view of an embodiment of a water spraying pipe according to the present invention.
Figure 2:
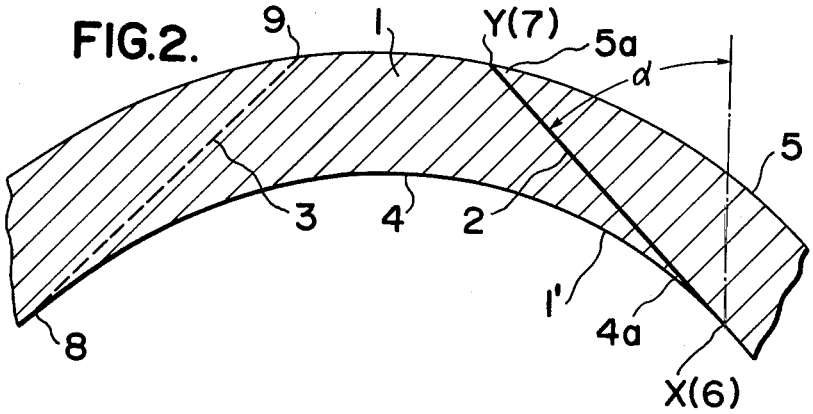
FIG. 2 is a partially enlarged sectional view taken along the line A–A′ of FIG. 1.

Referring to FIG. 1 and FIG. 2, there is shown an embodiment of a water sprayer pipe according to the present invention, wherein a water spraying angle of the slits of the pipe is 45 degrees from a horizontal plane. Namely, the slits are formed in the water sprayer pipe in such a fashion that the sprayed water reaches the longest distance.

A slit 2 is formed parallel to a water flow in a water sprayer pipe 1, and is formed in the direction of a tangent at a point X (refer to FIG. 2) on an inner surface 4 of the water sprayer pipe 1. The slit 2 extends up to a point Y on an outer surface 5 of the water sprayer pipe 1 (refer to FIG. 2). A water inlet 6 and a water outlet 7 of the slit 2 are formed in the same size and parallel to the water flow of the water sprayer pipe 1. A slit 3 is also formed in the water sprayer pipe 1, with a distance l from the slit 2, symmetrically with respect to a line passing through a center of the water sprayer pipe 1.

In the case where a number of such slits as the slit 2 and the slit 3 are formed in the water sprayer pipe 1 with a certain distance between them in the longitudinal direction of the water sprayer pipe 1, when a pressure water is supplied into the water sprayer pipe 1, the peripheral portions of the water sprayer pipe 1, in which the slits, such as the slits 2 and 3 are formed, are expanded greater in the direction of the diameter of the pipe 1 in comparison with the other peripheral portions of the water sprayer pipe 1 by the pressure of water since the peripheral portions having such slits therein become weaker than the other portions, whereby the slits are deformed and expanded and at the same time, the pressure water is sprayed from each slit, and within each slit, there are formed turbulent flows of water, and an acute angle inner portion 4*a* which is in contact with the water inlet 6 and the other acute angle outer portion 5*a* which is in contact with the water outlet 7 are caused to make complicated and minute vibrations, whereby water is divided into fine drops and is sprayed from the water outlet 6 of the slit 2.

In the case of the slit 3 adjacent the slit 2, the same vibrations occur as in the slit 2 when water is sprayed from the slit 2.

Such a water spray effect depends upon to what extent the inner portion 4*a* and the outer portion 5*a* are acute, which is determined by an angle of inclination of the slit 2 at the inner surface 4 and at the outer surface 5 of the water spray tube 1.

According to an experiment conducted by the inventor of the present invention, the limit angle of inclination from a tangent $\alpha$ shown in FIG. 2 is 45 degrees, and in the range of from more than 45 degrees to approximately 60 degrees, the water spray effect was found small and in 60 degrees or greater, the effect was the same as that of the conventional slits with $\alpha=90°$. Therefore, in the present invention, the angle of inclination of the slits is set in the range of from a tangent of the inner surface of the water sprayer pipe 1 to 45 degrees from the tangent.

Figure 3:
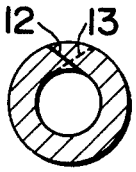
FIG. 3 is a schematic sectional view of another embodiment of a water spraying pipe according to the present invention.
Figure 4:
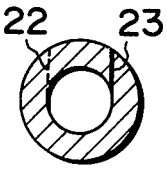
FIG. 4 is a schematic sectional view of a further embodiment of a water spraying pipe according to the present invention.

In the above-mentioned embodiment, water is sprayed from opposite sides of the water sprayer pipe 1. However, the water sprayer pipe 1 can be designed so as to spray water from one side of the water sprayer pipe 1. Furthermore, as shown in FIG. 3, slits 12 and 13 can be formed so as to spray water nearly horizontally. Alternatively, as shown in FIG. 4, slits 22 and 23 can be formed so as to spray water vertically.

Figure 5:
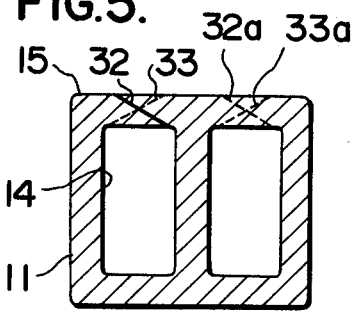
FIG. 5 is a schematic sectional view of a further embodiment of a water spraying pipe according to the present invention.

Referring to FIG. 5, there is shown a further embodiment of a water sprayer pipe 11 according to the present invention. This embodiment comprises a plurality of water paths whose vertical cross sections are rectangular. In this case, slits 32, 32*a*, 33 and 33*a* are all inclined with respect to the respective inner surfaces 14 and outer surface 15 within a range of not more than 45 degrees.

Figure 6:
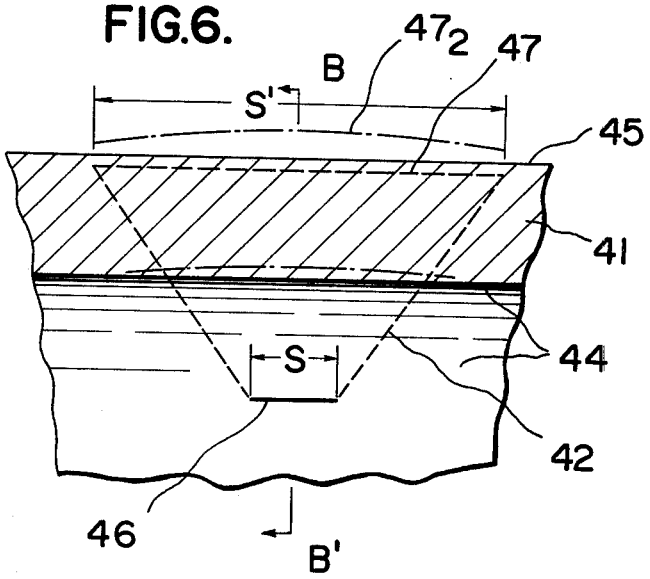
FIG. 6 is a partially enlarged sectional side view of a water spraying slit whose water outlet is longer than an inlet of the water spraying slit.

Referring to FIG. 6, there is shown a further embodiment of a water sprayer pipe 41 according to the present invention, wherein a slit 42 is designed in such a fashion that the width S' of an outlet 47 is larger than the width S of an inlet 46. In this design, water is sprayed more efficiently and the spraying angle is more widened in comparison with the previously mentioned water sprayer pipes.

Figure 7:
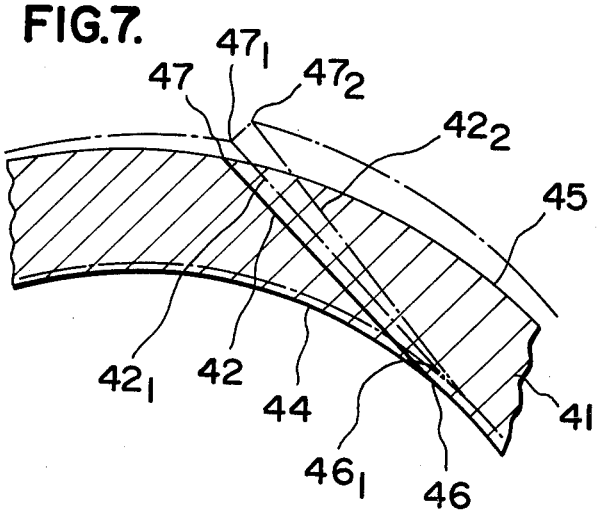
FIG. 7 is a partially enlarged sectional view of the water spray slit taken along the line B–B′ of FIG. 6, showing that the water spray slit is gradually deformed by a change of water pressure.

Referring to FIG. 7, there is shown an enlarged fragmentary sectional view of the slit portion of the water sprayer pipe 41 which is deformed by the supply of pressure water. To be more specific, the slit 42 of the water sprayer pipe 41 is shown by solid lines, in which the water inlet 46 of the inner wall 44 of the slit 42 extends in the direction of a tangent of the inner wall 44 up to the water outlet 47 of the outer wall 45. The water path of the slit 42 is elastically closed tightly when no pressure is applied to the slit 42. However, as the pressure of water is gradually increased, the diameter of the water spray tube 41 is increased over the whole length of the water sprayer pipe 41 and the diameter of the slit-formed portion becomes greater than that of the other portions, and the slit 42 is opened to position $42_1$, to position $42_2$, so that the water inlet 46 is slightly opened, for instance, up to position $46_1$, while the water outlet 47 is more opened to position $47_1$, to position $47_2$, whereby water spraying is started. According to an experiment conducted by the inventor of the present invention, initially when the water pressure is not high enough, water is sprayed in two lines from opposite ends of the water outlet 47. However, as the water pressure increases, water is sprayed from the whole range of the water outlet 47 so that the spraying of water is made more efficiently and the spraying distance and the spraying angle are increased, whereby the water spraying is made uniformly in a wide range.

In the present invention, the slits are formed in a water sprayer pipe in an inclined angle with respect to the pipe wall. Such slits can be formed by a cutting device with a keen edge, such as a razor, but a cutting method employing a keen blade of a low frequency vibration type with a 50 Hz of frequency and an approximately 1 mm of amplitude is preferable. However, the conventional cutting methods of an ultrasonic vibration type are not suitable for the present invention since heat is generated in the cutting portions of the water sprayer pipe, which deforms the cutting portions.

What is claimed is:

1. A liquid sprayer pipe made of flexible material with a plurality of liquid spraying slits through the wall thereof providing liquid passageways for the passage of liquid flowing through the pipe from an inlet on the inner surface of the wall to an outlet on the outer surface of the wall, said slits being arranged parallel to the direction of liquid flow in said liquid spraying pipe and inclined with respect to said inner and outer surfaces at an angle of up to 45°.

2. A liquid sprayer pipe of claim 1 in which the spraying slits are spaced longitudinally along one side of the liquid sprayer pipe.

3. A liquid sprayer pipe of claim 1 in which the spraying slits are spaced longitudinally along opposite sides of the liquid sprayer pipe.

4. A liquid sprayer pipe of claim 1 wherein the inlet and the outlet are of the same length.

5. A liquid sprayer pipe of claim 1 wherein the outlet is longer than the inlet.

6. A cylindrical liquid sprayer pipe made of flexible material with a plurality of liquid spraying slits through the wall thereof providing liquid passageways for the passage of liquid flowing through the pipe from an inlet on the inner surface of the wall to an outlet on the outer surface of the wall, said slits being arranged parallel to the direction of liquid flow in the pipe, tangent to said inner surface, and inclined with respect to said inner and outer surfaces at an angle of up to 45°.

7. A liquid sprayer pipe of claim 6 in which the spraying slits are spaced longitudinally along one side of the liquid sprayer pipe.

8. A liquid sprayer pipe of claim 6 in which the spraying slits are spaced longitudinally along opposite sides of the liquid sprayer pipe.

9. A liquid sprayer pipe of claim 6 wherein the inlet and the outlet are of the same length.

10. A liquid sprayer pipe of claim 6 wherein the outlet is longer than the inlet.

* * * * *